United States Patent [19]

Hilton

[11] Patent Number: 4,503,932

[45] Date of Patent: Mar. 12, 1985

[54] PERSONNEL ELEVATING APPARATUS

[75] Inventor: Allan R. Hilton, Bolton, England

[73] Assignee: Hilton (Products) Limited, Bolton, England

[21] Appl. No.: 337,185

[22] Filed: Jan. 5, 1982

[30] Foreign Application Priority Data

Jan. 7, 1981 [GB] United Kingdom ..... 8100362
Aug. 20, 1981 [GB] United Kingdom ..... 8125419

[51] Int. Cl.[3] ..... E06C 1/393

[52] U.S. Cl. ..... 182/113; 182/118; 182/152

[58] Field of Search ..... 182/152, 20, 21, 27, 182/33, 33.2, 33.4, 33.5, 156, 155, 106, 113, 129, 118; 297/37, 36, 41

[56] References Cited

U.S. PATENT DOCUMENTS

| | | | |
|---|---|---|---|
| 1,206,570 | 11/1916 | Marsh | 108/153 |
| 1,325,359 | 12/1919 | Elzey | 297/37 |
| 2,562,629 | 7/1951 | Miles | 297/37 |
| 2,954,073 | 9/1960 | Junkunc | 297/36 |
| 3,138,401 | 6/1964 | McLean | 297/36 |
| 3,195,680 | 7/1965 | Thornburg | 182/150 |
| 3,227,243 | 1/1966 | Bates | 182/156 |
| 3,618,704 | 11/1971 | Smith | 182/155 |

FOREIGN PATENT DOCUMENTS

| | | | |
|---|---|---|---|
| 129380 | 5/1901 | Fed. Rep. of Germany . | |
| 329915 | 5/1930 | United Kingdom | 182/129 |

*Primary Examiner*—Reinaldo P. Machado
*Assistant Examiner*—Alvin Chin-Shue
*Attorney, Agent, or Firm*—Sughrue, Mion, Zinn, Macpeak & Seas

[57] ABSTRACT

Personnel elevating apparatus comprises a support platform supportable above ground level on leg frames pivoted to the platform. Side guard rails extend upwardly therefrom in an erected position. An end support or hand rail is pivotally connected to each other and to the support platform. The support platform, leg frames, guard rails and support or hand rail are foldable into relatively flat condition. Pivoted to the leg frame at the support or hand rail end of the support platform a link rod is engageable with the other leg frame to serve as a leg strut, or with one of the guard rails to permit collapse or erection of the apparatus.

7 Claims, 10 Drawing Figures

PERSONNEL ELEVATING APPARATUS

This invention relates to apparatus for use by a person requiring to reach elevated locations normally out of his reach (hereinafter and in the claims simply called "personnel elevating apparatus").

As is well-known, the usual way to reach an elevated location is to use a ladder or step ladder but, on the whole, the user generally lacks a sense of security and it is an object of the present invention to provide an apparatus which fulfils this lack.

According to the present invention there is provided personnel elevating apparatus comprising an elevatable support platform dimensioned wholly to accommodate a person standing thereon to reach to an elevated location, and erectible safety guard rail means connected to the support platform and which, when collapsed, at least partially overlie the support platform thus impeding use of the latter until the guard rail means is erected.

As a result, the user not only has a support area of more than adequate dimension but also has peripheral security by way of the guard rail means.

In one form of the apparatus, the guard rail means preferably comprises a support frame pivoted at one end of the support platform and pivotally connected to two side guard rails, in turn, pivoted to the sides of the support platform, the support frame and guard rails being movable between a collapsed position where the support frame overlies the support platform in substantially parallel relationship with the guard rails alongside and an erected position where they are normal to the support platform.

In another form of the apparatus, the guard rail means preferably comprises a support frame pivoted at one end of the support platform and a guard rail pivoted to each side of the support platform and detachably connectible to the support frame, the support frame and guard rails being movable between a collapsed position where they overlie the support platform in substantially parallel relationship with the support frame and guard rails disconnected, and an erected position where they are normal to the support platform and are mechanically interlocked.

When in erected positions the support frame, in each case, is preferably higher than the side guard rails and is adapted to receive and detachably mount a receptacle and/or a work shelf whereby the user has readily to hand dusters, tools, paint pots, paint brushes or whatever else he requires.

It will be manifest from the above that access to the support platform is via the end of the latter remote from the erected support frame.

In said one form of the apparatus the support platform is preferably elevated from and maintained clear of the ground by end leg frames, one of which is an integral extension of the side guard rails while the other is pivoted to the support platform and connected to the support frame at the support end frame of the latter.

Preferably, a link rod is pivoted to said other leg frame and is engageable either with said one leg frame to serve as a leg strut and so prevent collapse of the erected apparatus, or with one of the guard rails to permit movement of the apparatus between collapsed and erected positions.

Alternatively, said other leg frame is connected to the support frame via slotted joints whereby, when the support frame is pivoted towards the support platform to overlie the latter, it is caused to pivot up against the underside of the support platform.

The support platform may, in the case of the other form of the apparatus, be elevated from and maintained clear of the ground by end leg frames pivoted to each end of the support platform for movement from overlying positions substantially parallel with the underside of the support platform to positions where they are substantially normal to the support platform.

In each case, the leg frame at the access end of the support platform preferably incorporates at least one mounting step to facilitate the user climbing onto the support platform.

The support platform may have at or adjacent each corner a depending formation, there being provided a front leg frame and a rear leg frame each with, at its upper end, a pair of complementary formations adapted to be engaged with the complementary formations at the front and the rear of the support platform respectively to elevate and maintain the latter above ground level.

Also according to the invention there is provided personnel elevating apparatus comprising a support platform supportable above ground level on leg frames pivoted to the platform and having, in an erected position, extending upwardly therefrom side guard rails and an end support or hand rail pivotally connected to each other and to the support platform, the support platform, leg frames, guard rails and support or hand rail being foldable into relatively flat condition, and there being pivoted to the leg frame at the support or hand rail end of the support platform a link rod engageable with the other leg frame to serve as a leg strut, or with one of the guard rails to permit collapse or erection of the apparatus.

Embodiments of the present invention will now be described, by way of example, with reference to the accompanying drawings, in which.

Figure 1:
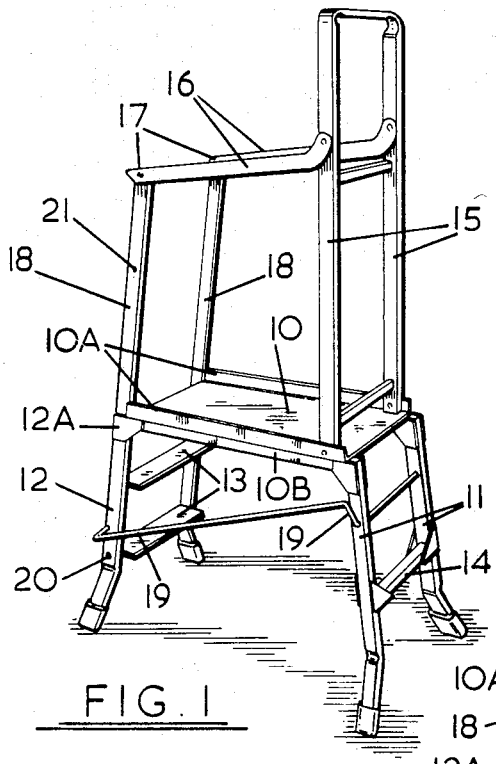
FIG. 1 is a perspective view of a first and preferred embodiment of personnel elevating apparatus according to the present invention in erected and working condition.
Figure 2:
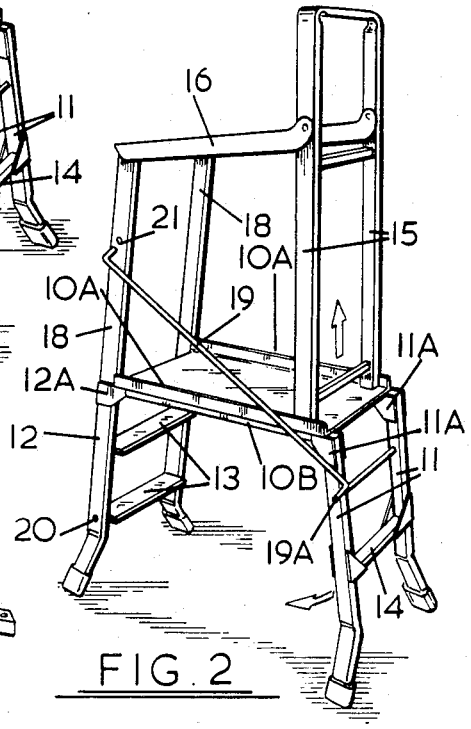
FIG. 2 is a perspective view of the apparatus just erected or just about to be collapsed.

The personnel elevating apparatus (FIGS. 1 to 4) comprises a support or working platform 10 to each end of which is pivoted a leg frame 11 and 12. More specifically, the front leg frame 12 is supported in brackets 12A pivoted to the support platform 10 which has, it is to be noted upstanding side walls 10A which assist in preventing a user's feet slipping off the platform surface. The rear leg frame 11 is also supported in brackets 11A pivoted to the platform 10.

These brackets 11A and 12A are pivoted to runners 10B on which the platform 10 is mounted.

The platform surface is conveniently made anti-skid for safety purposes.

The front frame 12 incorporates steps 13 to facilitate access to the working platform 10, while the rear leg frame 11 is braced as indicated at 14. It can be seen that both leg frames 11 and 12 are outwardly splayed at their bottom ends for stability.

A support or hand rail 15 is pivoted to the working platform 10 at the rear leg end frame end and to this rail 15 is pivoted a pair of lateral guard rails 16, each hinged at 17 to an upright 18 constituting part of the safety rail and rigid with the front leg frame 12.

A cranked link rod 19 pivoted transversely across the rear leg frame 11 can be engaged (see FIG. 1) in an aperture 20 in the front leg frame 12 where it acts as a leg strut and serves to stabilise the apparatus during use, or (see FIG. 2) in an aperture 21 in one of the uprights 18 of a guard rail 16 whereby it permits rear leg frame extension (apparatus erection) or retraction (apparatus collapse).

The relationship between the spacing of the apertures 20 and 21 and the length of the crank 19A of the link rod 19 ensures a stable erected apparatus and facilitates collapse and erection of the apparatus.

When the link rod 19 is fitted into aperture 21 it serves as an automatic actuator to open the apparatus to erected position since all a user has to do is to grip the hand rail 15 and lift the apparatus which causes the various components to pivot to open (erected) positions.

Figure 3:
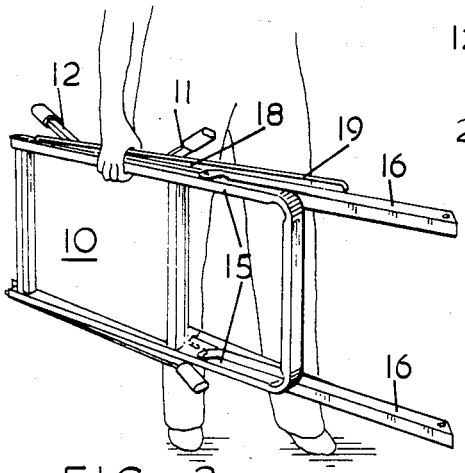
FIG. 3 is a perspective view of the collapsed apparatus.
Figure 4:
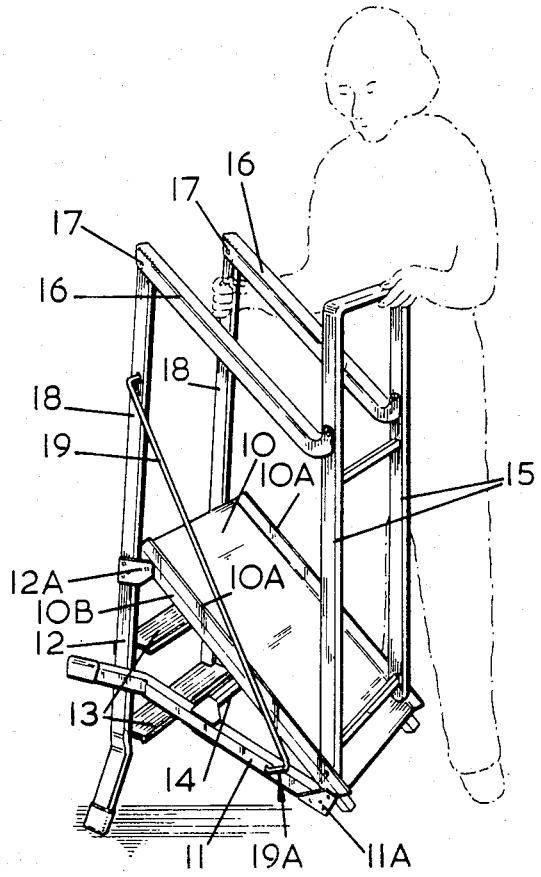
FIG. 4 is a perspective view of the apparatus between collapsed and erected positions.

With the link rod 19 engaged with the upright 18, the rear leg frame 11 can be folded up towards the bottom of the platform 10 while the front leg frame 12 also can fold in the same direction causing the uprights 18 and the guard rails 16 to move forwardly of the platform 10, and the hand rail 15 to pivot downwardly into contact with the platform 10 so that the apparatus is substantially flat (see FIGS. 3 and 4).

The above construction provides a personnel safety working platform since it cannot be used as a working platform unless both the hand and guard rails are in position, and which is extremely stable and provides a platform area on which the user can solidly stand fully on both feet.

It is to be noted that a receptacle for tools or other articles and/or a shelf or bench can be hung on the hand rail 15.

Figure 5:
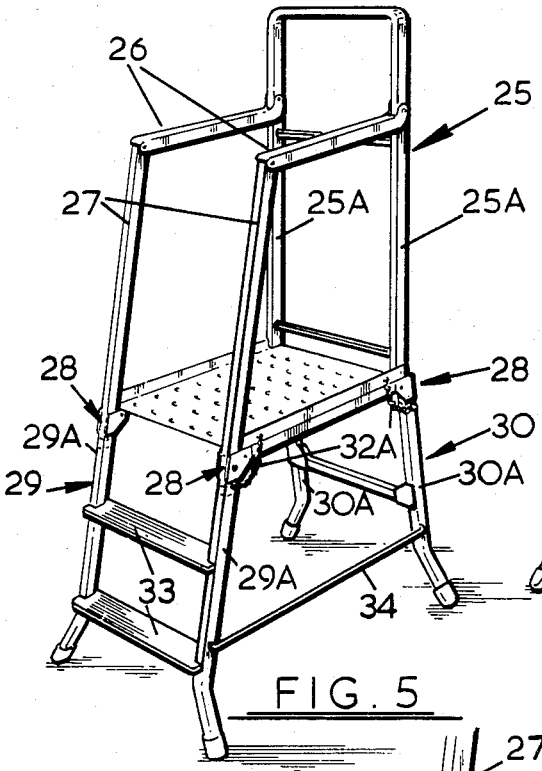
FIG. 5 is a perspective view of a second embodiment of the personnel elevating apparatus in erected condition, which apparatus is more suitable for use by tradesmen.
Figure 6:
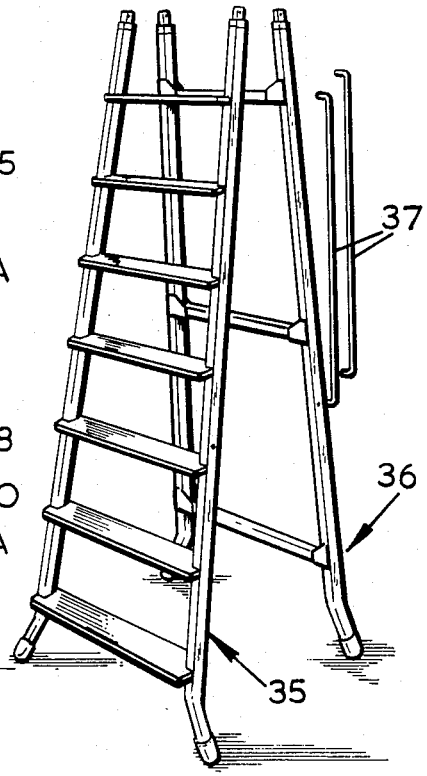
FIG. 6 is a perspective view of leg frames suitable for use with the apparatus of FIG. 5.

Referring now to FIGS. 5 to 6 there is shown a personnel elevating apparatus suitable for use by tradesmen or "do-it-yourself" enthusiasts who would wish to vary the height of the platform above the ground.

The platform, hand rail and guard rails are as described with reference to FIGS. 1 to 4 but the front and rear leg frames are not, in this embodiment, pivoted to the apparatus and the pivoted cranked leg strut is omitted.

Figure 5A:
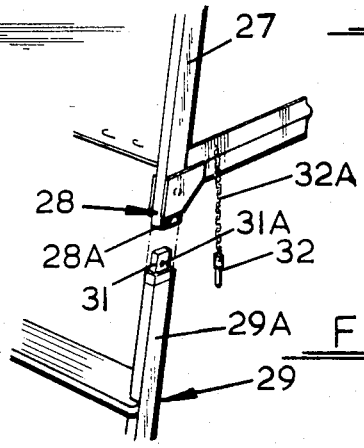
FIG. 5A is a perspective detail view of FIG. 5 to an enlarged scale.

In this embodiment the support or hand rail 25 and guard rails 26 including the uprights 27 each terminate at their bottom end in a socket configuration 28 (see FIG. 5A). That is, each upright 25A of the hand rail 25 and each upright 27 terminates in a socket configuration 28.

A separate front leg frame 29 and a separate rear leg frame 30 is provided, and each upright 29A and 30A of each leg frame 29, 30, terminates in a spigot configuration 31 for engagement in the corresponding socket configuration 28. These configurations 28 and 31 are apertured at 28A, 31A respectively so that when the spigots 31 are engaged in the sockets 28 the leg frames 29, 30 can be mechanically locked to the platform by pins 32 passing through aligned apertures 28A, 31A. These pins 32 are captive with the platform by means of chains 32A.

Each front leg frame 29 is provided with steps 33 to permit a user to climb onto the platform.

A removable strut 34 engages in holes in the leg frames 29, 30 to stabilise the apparatus.

If it is desired to increase the height of the platform above the ground then leg frames 29 and 30 are removed and replaced, say, by leg frames 35 and 36 (FIG. 6) with, in this instance, due to increased height two stabilising struts 37.

Figure 7:
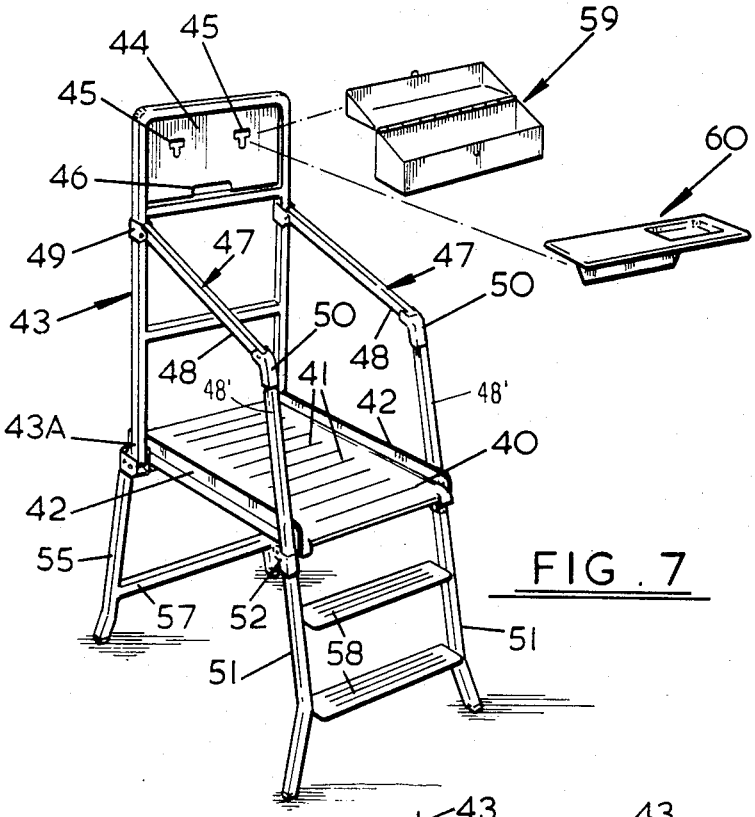
FIG. 7 is a perspective view of a third embodiment of the personnel elevating apparatus.
Figure 8:
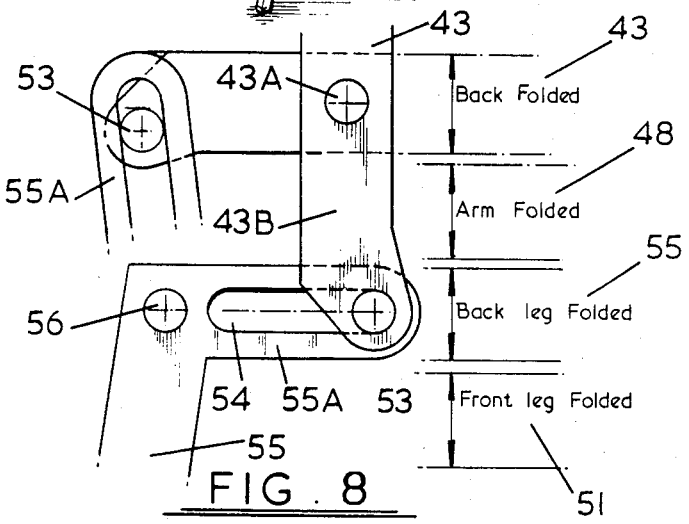
FIG. 8 is a detail view of a lost motion joint of the apparatus of FIG. 7.

Referring now to FIGS. 7 and 8, the erected personnel elevating apparatus comprises a rectangular support platform 40 adequately dimensioned, as with the platforms of the previous embodiments, not only to provide a stable base on which the user can solidly stand but also to provide a reasonable working length so that if, for example, the user is painting a wall he can cover a reasonably substantial area without having to stretch into a relatively unstable area as he would normally have to do if he was using conventional step ladders.

The platform 40 is ribbed at 41 to provide a non-slip surface but other means of achieving this may be employed.

The platform 40 has at each side a short upstanding wall 42 to impede a user's foot slipping off the side of the platform 40.

A support frame 43 is pivoted at 43A to the side walls 42 of the support platform 40 and has at its top a plate 44 with a pair of T-slots 45 for a purpose to be described later and a hand slot 46.

At each side of the support platform 40 is a guard rail 47 constituted by an arm 48 pivoted to the support frame 43 at 49, which arm 48 has an intermediate pivot joint 50 and a downwardly depending support segment 48' integral leg 51. The arm support segment 48' is also pivoted to the side of the support platform 40 as indicated at 52.

The support frame 43 (see FIG. 8) has an extension 43B at each side having a pin 53 (or alternatively a cross rod) movably received in a slot 54 of an extension 55A of a leg 55 pivotally connected at 56 to the support platform 40.

Legs 55 are connected by a cross bracing strut 57 while legs 51 are interconnected by steps 58 to facilitate access to the raised support platform 40.

Assuming the apparatus is in its erected position as shown to collapse the apparatus all that is necessary is to push the support frame 43 down towards the support platform 40 which causes the side guard rails 47 to fold about joints 50 and the rear legs 55 to pivot up underneath the support platform 40. In collapsed position, the support frame 43 overlies the support platform 40, the two jointed arms 48 and support segments 48' lie substantially in line with and forwardly of the support platform 40 and the integral legs 51 lie under the support platform 40 with the legs 55 therebetween.

To erect the apparatus from its collapsed position it is only necessary to lift it by the hand hole 46 clear of the ground and the various components automatically take up the positions shown in FIG. 7.

A removable receptacle 59 or flat top shelf 60 with sunken tray for materials or working tools can be secured to the plate 44 of the support frame 43 by projections (not shown) which engage in the T-slots 45. Such receptacle or shelf can take any convenient form.

Figure 9:
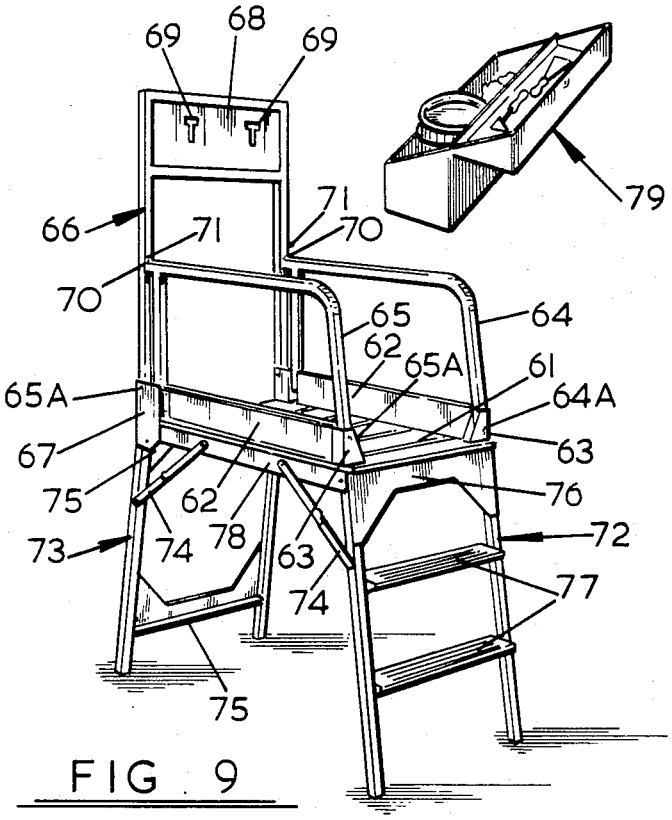
FIG. 9 is a perspective view of a fourth embodiment of personnel elevating apparatus.

Referring now finally to FIG. 9, the erected domestic personnel elevating apparatus comprises a rectangular non-slip support platform 61.

The platform 61 has at each side a short upstanding wall 62 having at one end a channel 63 in which are pivoted safety rails designated 64 and 65. It is to be noted that the pivot axis 64A of safety rail 64 is nearer the platform 61 than the pivot axis 65A of safety rail 65.

A support frame 66 is pivoted at 65A in channels 67. This support frame 66 is higher than the safety rails 64 and 65 and at its top has a plate 68 with a pair of T-slots 69 for a purpose to be described later.

The safety rails 64 and 65 and the support frame 66 are mechanically interlocked when in erected position by pins 70 retained on the support frame 66 by short lengths of chain (not shown), the pins 70 passing through rings 71 on the support frame 66 into holes (not shown) in the safety rails 64 and 65.

When these pins 70 are extracted it will be manifest that safety rail 64 can be folded down onto the platform 61 between the walls 62, then safety rail 65 can be folded down on top of safety rail 64 and finally support frame 66 can be folded down on top of rails 64 and 65. The safety rails 64 and 65 and support frame 66 when folded down have substantially the same total depth as the walls 62.

The platform 61, in use, is supported above ground level by two end leg frames 72 and 73, each pivotally connected to an end of the platform 61 and each connected to the platform 61 at each side by a centrally pivoted strut 74. The leg frame 73 incorporates two cross bracing members 75 and the leg frame 72 incorporates a top bracing member 76 and two steps 77 to permit access to the platform 61 from the ground.

When not in use the leg frames 72 and 73 fold in overlying relationship against the underside of the platform 61 between two stiffening side members 78 of the platform 61.

A removable receptacle or tray 79 for materials and working tools can be secured to the plate 68 of the support frame 66 by projections which engage in the T-slots 69. This receptacle or tray can take any convenient form and may, in fact be a simple shelf.

It will be manifest that with the receptacle or tray 79 removed and the pins 70 extracted, the personnel elevating apparatus of FIG. 9 can be easily collapsed into a much reduced bulk for carrying and/or storage purposes. Its weight and dimensions make it easily usable for a housewife about the house.

When the various above-described apparatuses are erected, a very stable platform with safety rails (including the support frame) on three sides is provided, and moreover there is also provided a platform dimensioned not only to permit the user to stand solidly thereon but also to provide a reasonable working length thus reducing the number of times the user has to dismount and move the apparatus on any particular task.

It will be manifest that the platform cannot be used until the safety rails including the support frame have been erected and preferably interlocked in the case of the FIG. 9 embodiment.

In the case of the FIGS. 5 to 6 embodiment, the leg frames may be employed in various combinations to, for example, provide a horizontal working platform in a stairway.

These leg frames may incorporate screw adjustable feet to permit compensation for ground unevenness.

The leg frames, when not in use with the apparatus, may be employed with a work top to provide a work bench for, for example, a vice, a saw, a drill and/or other tools.

Figure 10:
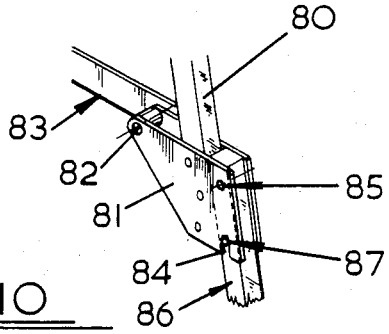
FIG. 10 is a detail perspective view of a modification of the personnel elevating apparatus illustrated in FIGS. 5, 5A and 6.

A modified connection between the detachable leg frames and the platform of the embodiment of FIGS. 5 to 6 is shown in FIG. 10. In this instance, each upright 80 is secured by rivetting between two plates 81 pivoted as indicated at 82 to the platform 83. The plates 81 project rearwardly or forwardly of the platform 83 and have in their bottom edges two slots 84 which are wider at the bottom than the top. The plates 81 are also provided with aligned holes 85 above the slots 84. Each leg frame 86 has near its top a cross-pin 87 projecting from the sides of each leg and the latter has above the cross-pin 87 a hole (not shown) which, in use of the platform, is aligned with holes 85.

When the leg frames 86 are fitted to the platform 83 the cross-pins 87 engage in the upper ends of the slots 84, the upper parts of the legs of each leg frame 86 lie against the lower part of the upright 80 and between the plates 81, and a locking pin (not shown), which may be attached to the platform 83 by a chain, is inserted through the aligned holes in the plates 81 and the leg.

An extensible ladder may also be provided for a tradesman, which ladder has equi-spaced holes in its sides so that when it is not being used conventionally it can be laid flat to form a track along which the personnel elevating apparatus of FIGS. 5 to 6 can be moved. For this purpose, pinion mechanisms are fitted to the bottom of the apparatus leg frames and engage in the aforesaid holes, the pinion mechanisms being pedal driven via a transmission belt or chain by the tradesman working on the platform. This allows him to move along a lengthy working area without having to dismount and bodily move the apparatus progressively along the area.

An outrigger arrangement may be provided for stability purposes.

What is claimed is:

1. Personnel elevating apparatus, comprising:

(a) a support platform (10) dimensioned wholly to accommodate a person standing thereon to reach an elevated location, (b) first leg means (11) pivoted to one end of the support platform and movable between an out-of-use position where the leg means lie substantially parallel alongside and underneath the support platform and an in-use position where the leg means are disposed substantially normal to and depending from the support platform, (c) second leg means (12) pivoted to the other end of the support platform, (d) an upright (18) extending upwardly from the second leg means at each side of the support platform, (e) the second leg means and uprights being movable between the out-of-use position where the second leg means lie underneath the support platform and the uprights lie forwardly of the platform, and the in-use position where they are disposed substantially normal to the support platform, the second leg means depending from the platform and the uprights extending above the platform, (f) step means (13) horizontally incorporated in the second leg means whereby a person can climb onto the support platform, (g) a support frame (15) including a top hand rail pivoted to said one end of the support platform and movable between the out-of-use position where it lies substantially parallel with the upper surface of the support platform and the in-use position where it extends upright from the support platform, (h) a lateral rail (16) at each side of the apparatus pivoted at one end to or adjacent to the end of one of the uprights and at the other end to one side of the support frame nearer the hand rail than the support platform, (i) the support frame and lateral rails defining a three-sided guard rail means around the sides and said one end of the support platform and the lateral rails being movable between the out-of-use position alongside the uprights and the in-use position normal to the uprights and support frame, and (j) strut means (19) pivoted to the first leg means and adjustable between a position (20) where it engages the second leg means to stabilise the apparatus in the in-use position and a position (21) where it engages an upright to facilitate collapse of the apparatus to the out-of-use position.

2. Personnel elevating apparatus as claimed in claim 1, in which, in the erected position, the support frame is greater in height than the lateral rails so that the hand rail can easily be grasped by a person standing on the support platform.

3. Personnel elevating apparatus as claimed in claim 1, in which the support frame is adapted to receive and detachably mount a receptacle for tools or a shelf.

4. Personnel elevating apparatus as claimed in claim 1, in which the strut means is a link rod of cranked configuration connected to and extending transversely of the first leg means, the link rod being movable at its other end between a position adjacent the lower end of the second leg means and a position adjacent the upper end of one of the uprights.

5. Personnel elevating apparatus as claimed in claim 1, in which the leg means subtend at slightly obtuse angles with the support platform when the apparatus is erected.

6. Personnel elevating apparatus as claimed in claim 1, in which the support platform has at opposed sides an upstanding wall (10A) to prevent a person standing thereon accidentally stepping out the side of the platform.

7. Personnel elevating apparatus, comprising:

(a) a support platform (40) dimensioned wholly to accommodate a person standing thereon to reach an elevated location, (b) first leg means (55) pivotally mounted at one end of the support platform and movable between an out-of-use position where the leg means lie substantially parallel with and under the support platform and an in-use position where the leg means are disposed substantially normal to and depending from the support platform, (c) a slotted extension (55A) at each end of the first leg means disposed alongside the support platform when the first leg means is in the in-use position, (d) second leg means (51) pivoted to the other end of the support platform, (e) an upright (48') extending upwardly from the second leg means at each side of the support platform, (f) the second leg means and uprights being movable between the out-of-use position where the second leg means lie underneath the support platform and the uprights lie forwardly of the platform, and the in-use position where they are disposed substantially normal to the support platform, the second leg means depending from the latter and the uprights extending above the latter, (g) step means (58) horizontally incorporated in the second leg means whereby a person can climb onto the support platform, (h) a support frame (43) including a top hand rail pivoted to said one end of the support platform and movable between the out-of-use position where it lies substantially parallel with the upper surface of the support platform and the in-use position where it extends upright from the support platform, (i) an extension (43B) at each side of the support frame movably engaging in the corresponding slotted extension of the first leg means to cause the latter to follow the movements of the support frame between the out-of-use and in-use positions, and (j) a lateral rail (48) at each side of the apparatus pivoted at one end to or adjacent to the end of one of the uprights and at the other end to one side of the support frame nearer the hand rail than the support platform.

* * * * *